US007308794B2

(12) United States Patent
Morenko et al.

(10) Patent No.: US 7,308,794 B2
(45) Date of Patent: Dec. 18, 2007

(54) COMBUSTOR AND METHOD OF IMPROVING MANUFACTURING ACCURACY THEREOF

(75) Inventors: Oleg Morenko, Mississauga (CA); Bhawan Bhai Patel, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 133 days.

(21) Appl. No.: 10/927,499

(22) Filed: Aug. 27, 2004

(65) Prior Publication Data

US 2006/0042271 A1 Mar. 2, 2006

(51) Int. Cl.
*F02C 1/00* (2006.01)

(52) U.S. Cl. ..... 60/752; 60/754; 60/772

(58) Field of Classification Search ..... 60/772, 60/752–760

See application file for complete search history.

(56) References Cited

U.S. PATENT DOCUMENTS

| | | | | | |
|---|---|---|---|---|---|
| 3,098,357 | A | | 7/1963 | Marsh | |
| 3,383,855 | A | * | 5/1968 | Freeman et al. | 60/757 |
| 3,831,854 | A | * | 8/1974 | Sato et al. | 239/406 |
| 3,869,864 | A | * | 3/1975 | Bunn | 60/757 |
| 3,916,619 | A | * | 11/1975 | Masai et al. | 60/756 |
| 3,943,703 | A | * | 3/1976 | Kronogard | 60/791 |
| 4,195,476 | A | | 4/1980 | Wood | |
| 4,226,088 | A | * | 10/1980 | Tsukahara et al. | 60/752 |
| 4,497,170 | A | | 2/1985 | Elliot et al. | |
| 4,532,762 | A | | 8/1985 | Mongia et al. | |
| 4,594,848 | A | * | 6/1986 | Mongia et al. | 60/772 |
| 4,651,534 | A | * | 3/1987 | Stroem | 60/732 |
| 5,012,645 | A | * | 5/1991 | Reynolds | 60/754 |
| 5,117,637 | A | | 6/1992 | Howell et al. | |
| 5,129,231 | A | * | 7/1992 | Becker et al. | 60/754 |
| 5,209,066 | A | * | 5/1993 | Barbier et al. | 60/732 |
| 5,235,812 | A | | 8/1993 | Klaass et al. | |
| 5,253,471 | A | * | 10/1993 | Richardson | 60/804 |
| 5,307,637 | A | * | 5/1994 | Stickles et al. | 60/756 |
| 5,479,782 | A | | 1/1996 | Parker et al. | |
| 5,490,389 | A | * | 2/1996 | Harrison et al. | 60/737 |
| 5,509,270 | A | * | 4/1996 | Pearce et al. | 60/740 |
| 5,628,193 | A | * | 5/1997 | Kington et al. | 60/752 |
| 5,816,041 | A | | 10/1998 | Greninger | |
| 5,918,467 | A | * | 7/1999 | Kwan | 60/754 |
| 5,956,955 | A | * | 9/1999 | Schmid | 60/748 |
| 5,996,351 | A | | 12/1999 | Feitelberg et al. | |
| 6,079,199 | A | * | 6/2000 | McCaldon et al. | 60/800 |
| 6,134,877 | A | * | 10/2000 | Alkabie | 60/800 |
| 6,155,056 | A | * | 12/2000 | Sampath et al. | 60/756 |
| 6,253,538 | B1 | * | 7/2001 | Sampath et al. | 60/776 |
| 6,279,323 | B1 | * | 8/2001 | Monty et al. | 60/752 |
| 6,497,105 | B1 | | 12/2002 | Stastny | |
| 6,546,733 | B2 | | 4/2003 | North et al. | |
| 6,679,063 | B2 | * | 1/2004 | Ebel | 60/798 |
| 6,735,950 | B1 | * | 5/2004 | Howell et al. | 60/748 |
| 6,751,961 | B2 | * | 6/2004 | Pacheco-Tougas et al. | 60/752 |
| 6,955,053 | B1 | * | 10/2005 | Chen et al. | 60/804 |
| 6,978,618 | B2 | * | 12/2005 | Pacheco-Tougas et al. | 60/752 |

(Continued)

*Primary Examiner*—William H. Rodriguez
(74) *Attorney, Agent, or Firm*—Ogilvy Renault LLP

(57) ABSTRACT

An improved gas turbine engine combustor with a liner and a dome connected to the liner trough small radius transition portions only, the dome having a plurality of fuel nozzles mounted therein and an interior directly exposed to a combustion region of the combustor, the dome including a plurality of effusion cooling holes provided non-perpendicularly to an entry surface of the holes, the dome being substantially planar.

16 Claims, 4 Drawing Sheets

U.S. PATENT DOCUMENTS

2004/0112061 A1* 6/2004 Oskooei et al. ..... 60/776
2005/0015964 A1* 1/2005 Prociw et al. ..... 29/527.4
2005/0120718 A1* 6/2005 Markarian et al. ..... 60/800
2005/0144956 A1* 7/2005 Alkabie ..... 60/772
2006/0053797 A1* 3/2006 Stastny et al. ..... 60/772

* cited by examiner

COMBUSTOR AND METHOD OF IMPROVING MANUFACTURING ACCURACY THEREOF

TECHNICAL FIELD

The present invention relates generally to gas turbine engine combustors and, more particularly, to a low cost combustor configuration having improved performance.

BACKGROUND OF THE ART

Gas turbine combustors are the subject of continual improvement, to provide better cooling, better mixing, better fuel efficiency, better performance, etc. at a lower cost. Also, a new generation of very small gas turbine engines is emerging (i.e. a fan diameter of 20 inches or less, with about 2500 lbs. thrust or less), however larger designs cannot simply be scaled-down, since many physical parameters do not scale linearly, or at all, with size (droplet size, drag coefficients, manufacturing tolerances, etc.). There is, therefore, a continuing need for improvements in gas turbine combustor design.

SUMMARY OF THE INVENTION

In accordance with the present invention there is provided a gas turbine engine combustor comprising a liner defining an annular reverse-flow configuration, the liner extending from an annular upstream dome to a downstream exit, the liner reversing direction thereinbetween, the dome having a plurality of fuel nozzle mounted therein, the dome having an interior directly exposed to a combustion region of the combustor, the dome further including a plurality of effusion cooling holes provided non-perpendicularly to an entry surface of the holes, the effusion cooling holes adapted in use to cool the dome to relieve heat transferred from the combustion region, the dome being substantially planar.

In accordance with another aspect there is also provided a method a method of improving manufacturing accuracy of a heat shieldless annular reverse flow combustor, the method comprising the steps of providing a annular reverse flow combustor with an end dome adapted for receiving a fuel nozzle; maximizing a flat area of the end dome, the flat area disposed generally perpendicularly to a combustor axis; and drilling a plurality of effusion cooling holes in the flat area of the dome, to thereby improve the overall manufacturing tolerances of said drilling.

Further details of these and other aspects of the present invention will be apparent from the detailed description and Figures included below.

DESCRIPTION OF THE DRAWINGS

Reference is now made to the accompanying Figures depicting aspects of the present invention, in which.

DETAILED DESCRIPTION OF PREFERRED EMBODIMENTS

Figure 1:
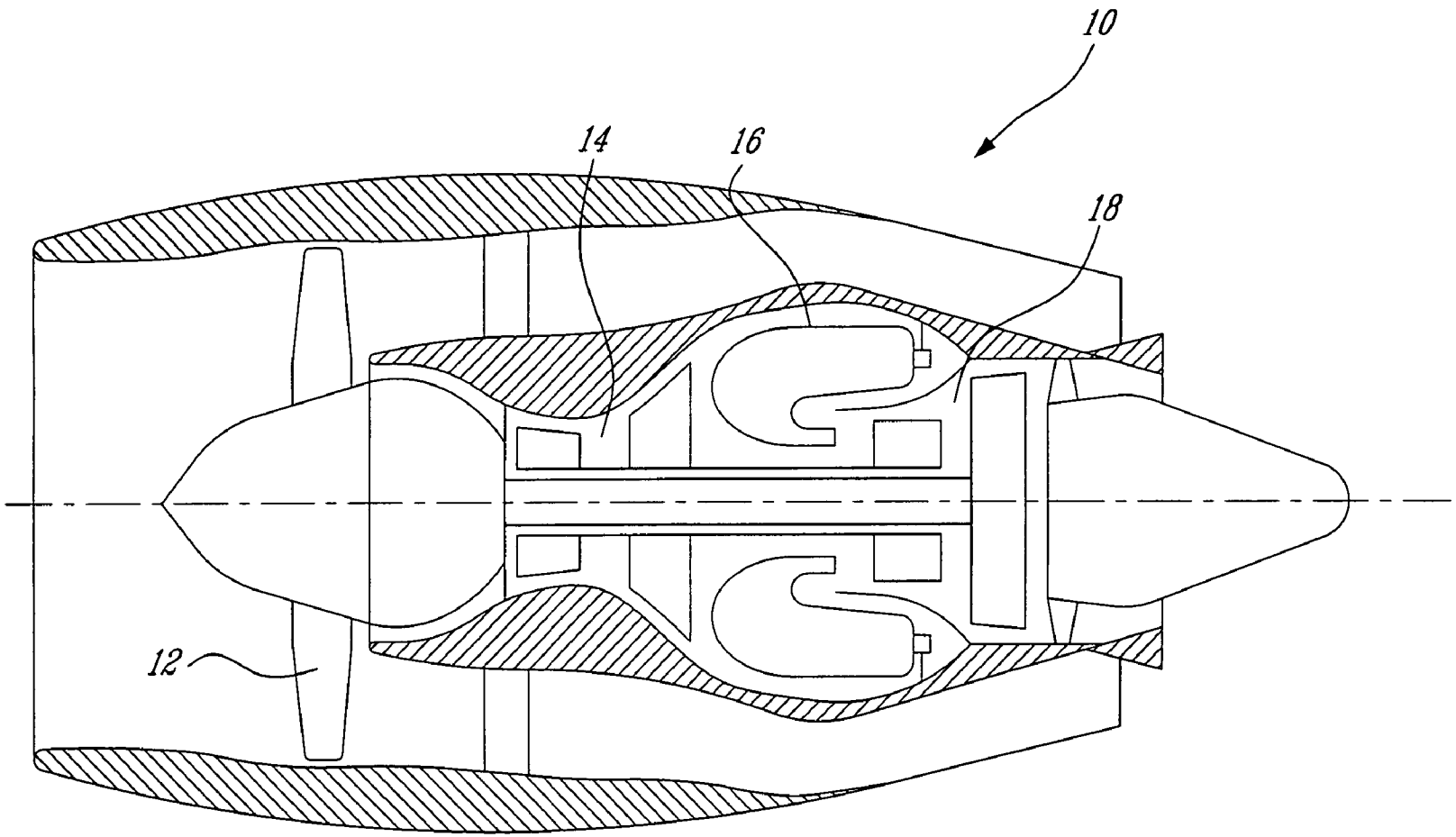
FIG. 1 shows a schematic cross-section of a turbofan engine having an annular combustor.

FIG. 1 illustrates a gas turbine engine 10 preferably of a type provided for use in subsonic flight, generally comprising in serial flow communication a fan 12 through which ambient air is propelled, a multistage compressor 14 for pressurizing the air, an annular combustor 16 in which compressed air is mixed with fuel and ignited for generating an annular stream of hot combustion gases which is then redirected by combustor 16 to a turbine section 18 for extracting energy from the combustion gases.

Figure 2:
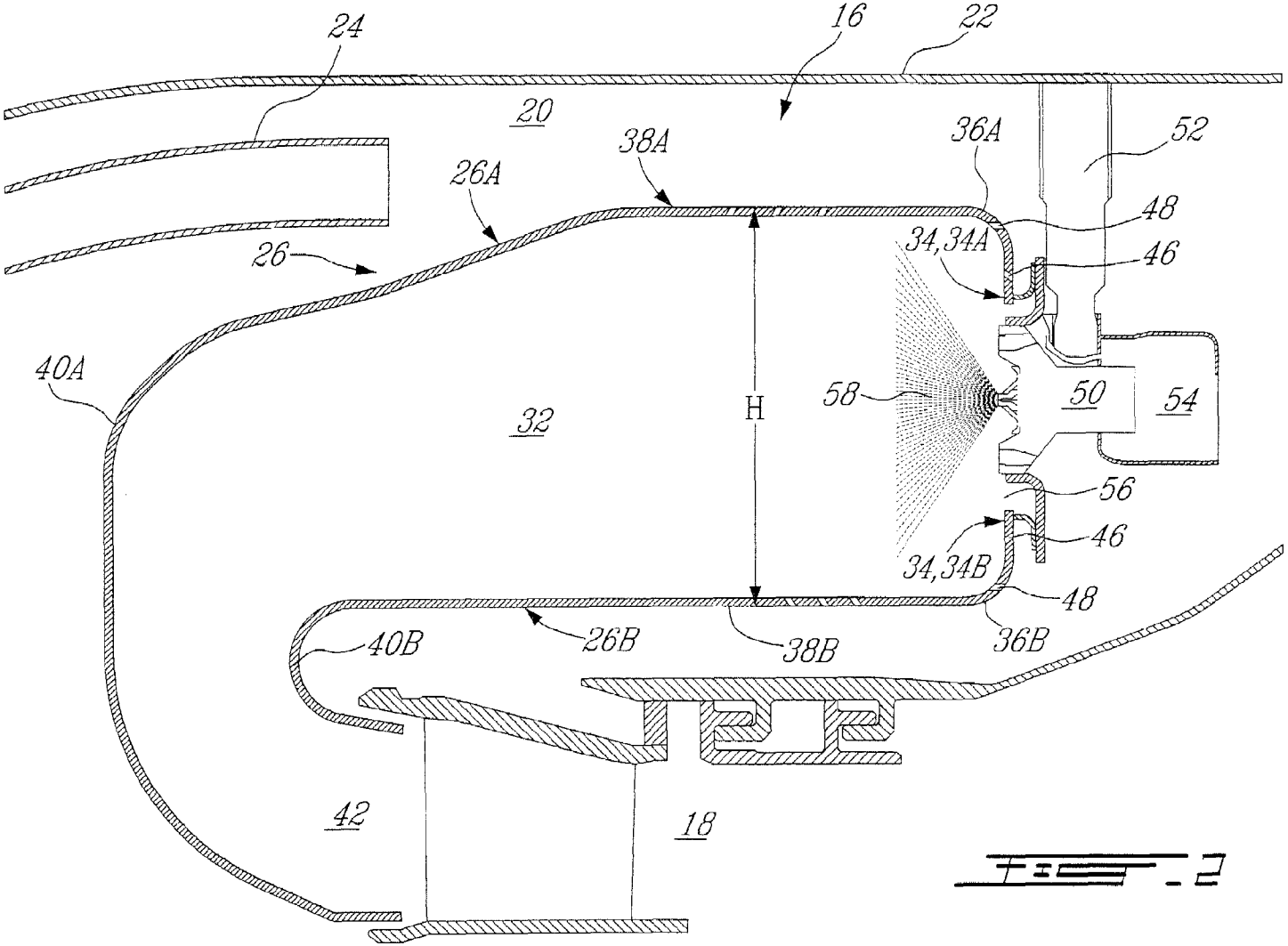
FIG. 2 shows an enlarged view of the combustor of FIG. 1.

Referring to FIG. 2, the combustor 16 is housed in a plenum 20 defined partially by a gas generator case 22 and supplied with compressed air from compressor 14 by a diffuser 24. Combustor 16 comprises generally a liner 26 composed of an outer liner 26A and an inner liner 26B defining a combustion chamber 32 therein. Combustor 16 preferably has a generally flat dome 34, as will be described in more detail below. Outer liner 26A includes a outer dome panel portion 34A, a relatively small radius transition portion 36A, a cylindrical body panel portion 38A, long exit duct portion 40A, while inner liner 26B includes an inner dome panel portion 34B, a relatively small radius transition portion 36B, a cylindrical body panel portion 38B, and a small exit duct portion 40B. The exit ducts 40A and 40B together define a combustor exit 42 for communicating with turbine section 18. The combustor liner 26 is preferably sheet metal.

Figure 3:
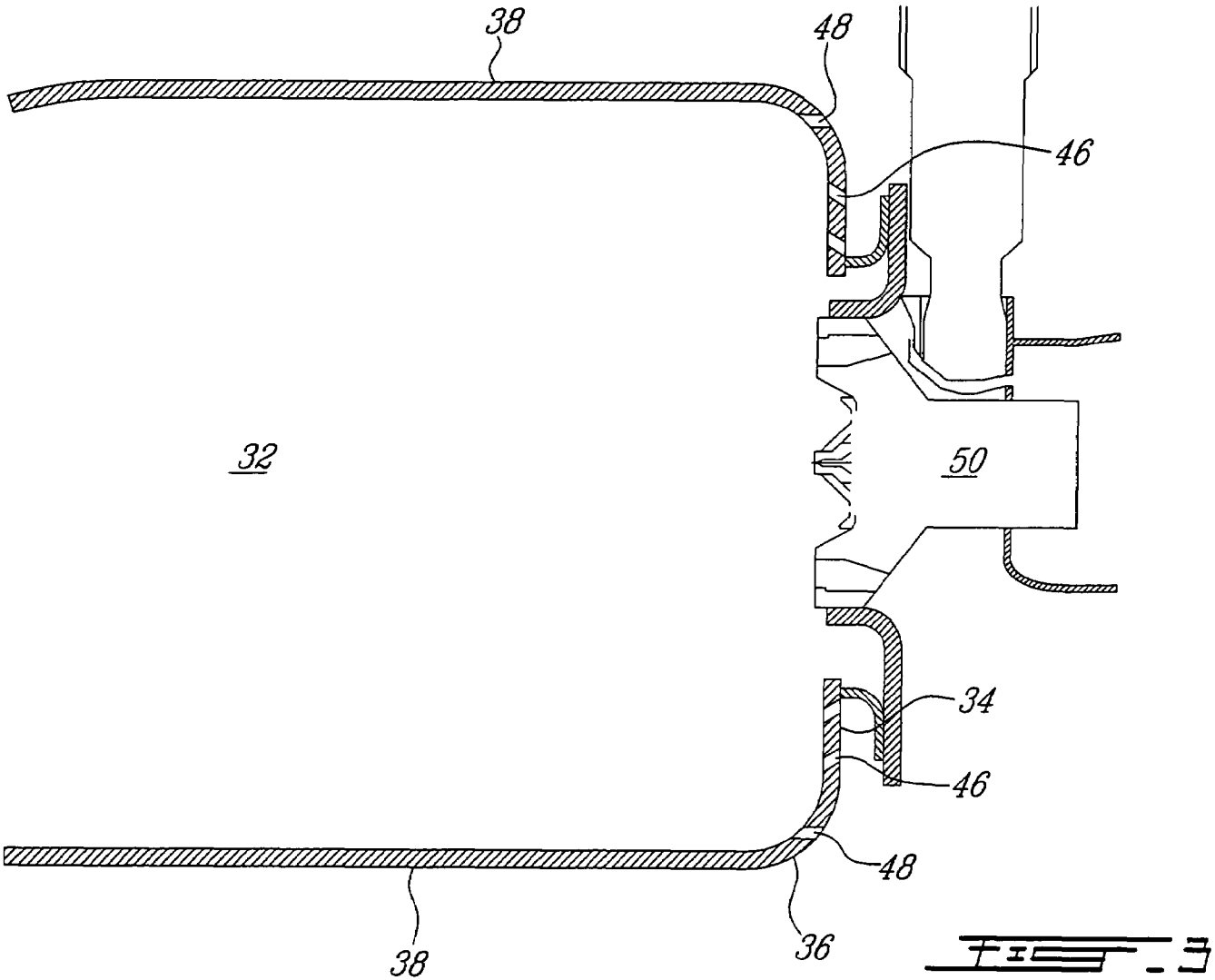
FIG. 3 is a further enlarged view of FIG. 2.

Referring to FIG. 3, a plurality of effusion cooling holes 46 are provided in dome 34, and a plurality of holes 48 in transition 36. Dome 34 has no heat shield provided therein, and therefore holes 46 provide enough cooling to protect the dome end of the combustor. Effusion cooling holes 46 are angled at precise angles, and positioned at precise positions to provide the exact flow inside the combustor or operate it as efficiently as desired and for the desired maintenance interval before repair or replacement is required. Placement tolerances on the position of the holes, therefore, is typically less than 0.050" while angular tolerances are a few degrees or less, the significance of which will be discussed further below.

Dome 34 includes a flat, planar area which is preferably optimized to be as large as possible, as will be discussed below.

A plurality of air-guided fuel nozzles 50, having supports 52 and supplied with fuel from internal manifold 54, communicate with the combustion chamber 32 through nozzle openings 56 to deliver a fuel-air mixture 58 to the chamber 32. As depicted in FIG. 2, the fuel-air mixture is delivered in a cone-shaped spray pattern, and therefore referred to in this application as fuel spray cone 58.

In use, referring again to FIGS. 2 and 3, high-speed compressed air enters plenum 20 from diffuser 24. The air circulates around combustor 16, as will be discussed in more detail below, and eventually enters combustion chamber 32, inter alia, through a plurality of effusion cooling holes 46 in dome 34, and holes 48 in transition 36. Once inside the combustor 16, the air is mixed with fuel and ignited for combustion. Combustion gases are then exhausted through exit 42 to turbine section 18.

Effusion cooling of dome 34 is achieved by directing air though angled holes 46 in a combustor liner. Holes 46 in dome panel 34 are angled outwardly away from nozzle 50, while holes 48 in transition portions 36A,B are provided generally parallelly to body panel portion 38A,B to direct cooling air in a louver-like fashion along the interior of body panel portions 38A,B to cool them.

The combustor 16 is preferably provided in sheet metal, and may be made by any suitable method. Holes 46 are preferably drilled in the sheet metal, such as by laser drilling. It will be appreciated that some holes 46 are provided relatively close to body panels 38A,B, and necessarily are so to provide good film cooling of the outer portions of dome 34.

Figure 4:
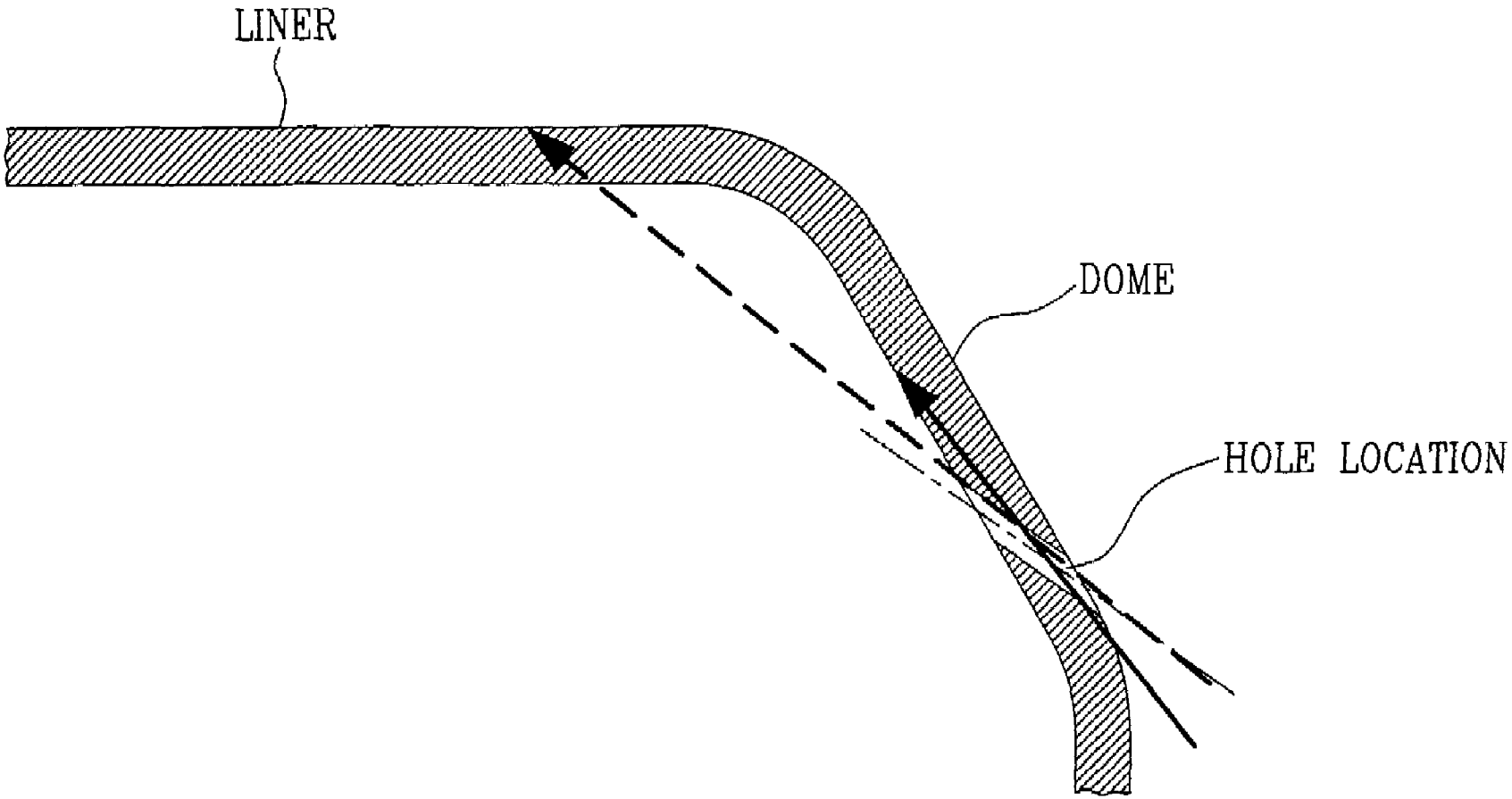
FIG. 4 (PRIOR ART)
FIG. 4 is a somewhat schematic cross-sectional view of a portion of a prior art combustor.

Referring to the prior art depicted in FIG. 4, while drilling of combustor holes an be controlled with great precision, such precision adds to the cost of the part. As well, the positional and angular manufacturing tolerances provided may result in some over-drilling of holes 46 (represented by the stippled arrow) which can result in damage to the liner, or may result in holes which are not entirely drilled-through (represented by the solid arrow). Holes may also be mislocated, resulted in hot spots, etc. As gas turbine engine size decreases, manufacturing tolerances of course do not scale linearly (if at all) and, hence, such manufacturing tolerance issue become increasingly critical to combustor design.

Referring again to FIG. 3, the inventors have recognized that the manufacturing tolerances which must be provided when hole-drilling on non-planar combustor walls is greater than is required for a planar surface. Accordingly, therefore, providing combustor 16 with small radius transition portions 36A,B and a flat dome permits drilling to completed more precisely, more easily and with minimal risk of damaging the adjacent body panels. As mentioned, this is because manufacturing tolerances for drilled holes provided on curved or conical surfaces are much larger than the comparable tolerances for drilling on a flat, planar surface. Thereby, maximizing the flat area of the combustor dome, the present invention provides an increase area over which cooling holes may be more accurately provided. This is especially critical in heat shield-less combustor designs (i.e. in which the liner has no inner heat shield, but rather the dome is directly exposed to the combustion chamber), since the cooling of the dome therefore become critical, and the cooling pattern must be precisely provided therein. By improving the manufacturing tolerances of the combustor dome, the chance of holes not completely drilled-through, or drilling damage occurring on a liner surface downstream of the drilled hole (i.e. caused by the laser or drilling mechanism hitting the liner after completing the hole) are advantageously reduced. Thus, by making the dome end flat, holes may be drilled much closed to the "corners" (i.e. the intersection between the dome and the side walls), with reduced risk of accidentally damaging the liner side walls downstream of the hole (i.e. by over-drilling). The invention therefore, is particularly applicable to very small turbofan gas engines, having a fan size of 24 inches or less, and more preferably, 20 inches or less, in which engines the annular combustor height, shown at H in FIG. 2, may be 4 inches or less. Although a flat dome, depending on its configuration, may present dynamic or buckling issues in larger-sized configurations, the very small size of a combustor for a very small gas turbine engine will in part reduce this tendency. The curved transition portions also provide some strength, as compared to a perpendicular corner. This aspect of the invention is thus particularly suited for use in very small gas turbine engines. In contrast, conventional annular reverse-flow combustors have curved domes to provide stability against dynamic forces and buckling. However, as mentioned, this typical combustor shape presents interference and tolerance issues, particularly when providing a heat shield-less combustor dome.

Advantageously, in very small combustor designs, a flat-domed combustor also permits the enclosed volume of the combustor to be maximized within a minimum envelope.

The above description is meant to be exemplary only, and one skilled in the art will recognize that further changes may be made to the embodiments described without departing from the scope of the invention disclosed. Modifications will be apparent to those skilled in the art, in light of a review of this disclosure, and such modifications are intended to fall within the appended claims.

We claim:

1. A gas turbine engine combustor comprising a liner defining an annular reverse-flow configuration, the liner extending from an annular upstream dome to a downstream exit, the liner reversing direction thereinbetween, the liner including an inner liner and an outer liner, the dome being substantially planar and substantially perpendicular to an upstream end portion of at least the inner liner, the dome being connected to at least the inner liner through a continuously rounded transition portion extending from the planar dome to the upstream end portion of the inner liner, the dome having a plurality of fuel nozzles mounted therein, the dome having an interior directly exposed to a combustion region of the combustor, the dome further including a plurality of effusion cooling holes provided non-perpendicularly to an entry surface of the holes, the effusion cooling holes in use cooling the dome to relieve heat transferred from the combustion region.

2. The combustor according to claim 1, wherein the combustor has a height of at most 4 inches, the height being defined between an outer surface of the outer liner and an inner surface of the inner liner.

3. The combustor of claim 1, wherein the dome, liner, and transition portion are sheet metal.

4. The combustor of claim 1, wherein the effusion cooling holes are angled in a downstream direction toward an adjacent part of the transition portion.

5. The combustor of claim 1, wherein the transition portion is provided by bent sheet metal.

6. The combustor of claim 1, wherein the transition portion includes al least one cooling hole.

7. The combustor of claim 6, wherein at least one annular row of cooling holes are defined in the transition portion.

8. The combustor of claim 7, wherein the cooling holes in the transition portion extend therethrough in a direction that is generally parallel to the inner and outer liners downstream from the transition portion.

9. The combustor of claim 1, wherein the dome, liner, and transition portion arc substantially the same thickness.

10. The combustor of claim 1, the dome being substantially perpendicular to the upstream end portion of both the inner liner and the outer liner.

11. The combustor of claim 1, wherein the dome, the transition portion and the liner have substantially constant thickness.

12. The combustor of claim 1, wherein the dome, the transition portion and the liner respectively define inner and outer surfaces, said inner and outer surfaces being substantially parallel to each other.

13. The combustor of claim 1, wherein the dome lies in a plane that is substantially perpendicular to a longitudinal main engine axis.

14. The combustor of claim 1, wherein the plurality of effusion cooling holes in the dome comprise at least two.

15. A method of improving manufacturing accuracy of a heat shieldless annular reverse flow combustor, the method comprising the steps of:

providing an annular reverse flow combustor with an end dome adapted for receiving a fuel nozzle;

providing a planar portion of the end dome, the planar portion being disposed substantially perpendicularly to a combustor axis;

forming a continuously rounded transition portion extending from the dome to upstream end portions of inner and outer liners of the combustor; and drilling a plurality of effusion cooling holes in the planar portion of the dome; to thereby improve the overall manufacturing tolerances of said drilling, the effusion cooling holes being drilled non-perpendicularly to an entry surface of the holes in the planar portion of the dome.

16. The method of claim 15, further comprising drilling a plurality of the cooling holes in said continuously rounded transition portion.

* * * * *